US005305592A

United States Patent [19]

Schulz et al.

[11] Patent Number: 5,305,592

[45] Date of Patent: Apr. 26, 1994

[54] GRAB-CLEARING SYSTEM FOR TUBE-CHANGING APPARATUS

[75] Inventors: Günter Schulz, Ebersbach/Fils; Gerd Stölzner, Urbach, both of Fed. Rep. of Germany

[73] Assignee: Zinser Textilmaschinen GmbH, Ebersbach/Fils, Fed. Rep. of Germany

[21] Appl. No.: 878,152

[22] Filed: May 4, 1992

[30] Foreign Application Priority Data

May 15, 1991 [DE] Fed. Rep. of Germany ..... 4115772

[51] Int. Cl.[5] ..... D01H 5/66; D01H 3/16

[52] U.S. Cl. ..... 57/304; 57/274; 57/305; 57/306; 15/316.1

[58] Field of Search ..... 15/301, 312.1, 316.1; 57/274, 275, 303, 304, 305, 306, 281, 90

[56] References Cited

U.S. PATENT DOCUMENTS 2,962,856 12/1960 Ingham ..... 57/275
3,542,595 11/1970 McCullough ..... 134/34
4,484,434 11/1984 Rummele ..... 57/304
4,594,845 6/1986 Matsui ..... 57/304
4,628,686 12/1986 Tone et al. ..... 57/305 X
5,058,372 10/1991 Staedele ..... 57/274

FOREIGN PATENT DOCUMENTS

3425545C2 11/1987 Fed. Rep. of Germany .

*Primary Examiner*—Daniel P. Stodola
*Assistant Examiner*—William Stryjewski
*Attorney, Agent, or Firm*—Herbert Dubno; Andrew Wilford

[57] ABSTRACT

A cleaning apparatus used in a spinning machine wherein a row of grabs having seats can be engaged over tubes in respective spinning stations to remove the tubes from and insert the tubes into the respective stations has at least one nozzle directable into the seats of the grabs and a system for supplying air under pressure to the nozzle and thereby forming at the nozzle a jet that blows lint and the like from the seat into which the nozzle is directed.

9 Claims, 2 Drawing Sheets

GRAB-CLEARING SYSTEM FOR TUBE-CHANGING APPARATUS

FIELD OF THE INVENTION

The present invention relates to a tube-changing apparatus of a spool changing apparatus of a spinning machine or the like. More particularly this invention concerns a system for clearing the grabs of such a machine.

BACKGROUND OF THE INVENTION

In a standard ring-spinning machine as described in commonly owned and copending U.S. patent application 07/799,820 filed 25 November 1991 respective filaments are wound up onto respective tubes on respective spindles carried in a long row on a bank of such spindles, and in some arrangements filaments are pulled off rows of tubes similarly mounted on spindles. An equally long doffing apparatus has respective grabs that engage the tops of the tubes and remove same from the spindles, while a similar such machine or even the same one can mount replacement tubes on the spindles.

Such a machine works in an environment filled with lint and filament particles that get into everything. It is known, for instance from German patent 3,425,545 filed by I. Matsui with a claim to a Japanese priority of 11 July 1983, to provide an arrangement of blow nozzles and vacuum ports to try to control this dust, but such machines are mainly aimed at overall control of lint in the region of the machine. With time lint particles clog the seats of the grabs so that tubes cannot fit properly in them. Accordingly the machine must be periodically downed and the seats of the grabs must be individually cleaned. This is done as infrequently as possible to avoid excessive down time so that the buildup of lint is often allowed to progress to a point where several grabs of the apparatus are so fouled with lint as to be inoperative well before they are due for periodic cleaning.

OBJECTS OF THE INVENTION

It is therefore an object of the present invention to provide an improvement in a donning/doffing machine that over-comes this problem.

Another object is the provision of such an improved machine that completely avoids the necessity of periodic cleaning of the grabs.

SUMMARY OF THE INVENTION

The instant invention is a cleaning apparatus used in a spinning machine wherein a row of grabs having seats can be engaged over tubes in respective spinning stations to remove the tubes from and insert the tubes into the respective stations. The cleaning apparatus has according to the invention at least one nozzle directable into the seats of the grabs and a system for supplying air under pressure to the nozzle and thereby forming at the nozzle a jet that blows lint and the like from the seat into which the nozzle is directed.

Thus with the arrangement of this invention equipment is provided which can blow out the critical seat regions of the grabs. This can be done periodically or as needed, but in any case need not be a tricky manual procedure and can be carried out during a time in the work cycle that robs no production time from the spinner.

In accordance with the invention each grab is provided with a respective such nozzle. Alternately a guide extends along the row of grabs and the nozzle can be displaced along the guide to direct the air blast into the grabs sequentially.

In an arrangement where the grabs are each movable along a predetermined path the nozzles are disposed along the paths for directing the jets into the grabs as same pass.

Normally according to this invention the seats of the grabs are downwardly open cavities. The nozzle can be directed upward into the cavity of each grab or the grabs can be formed with respective passages each having a downstream end open downward into the respective cavity and an upstream end in which case the nozzle is directed into the upstream passage end.

BRIEF DESCRIPTION OF THE DRAWINGS

The above and other objects, features, and advantages will become more readily apparent from the following, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing.

SPECIFIC DESCRIPTION

Figure 1:
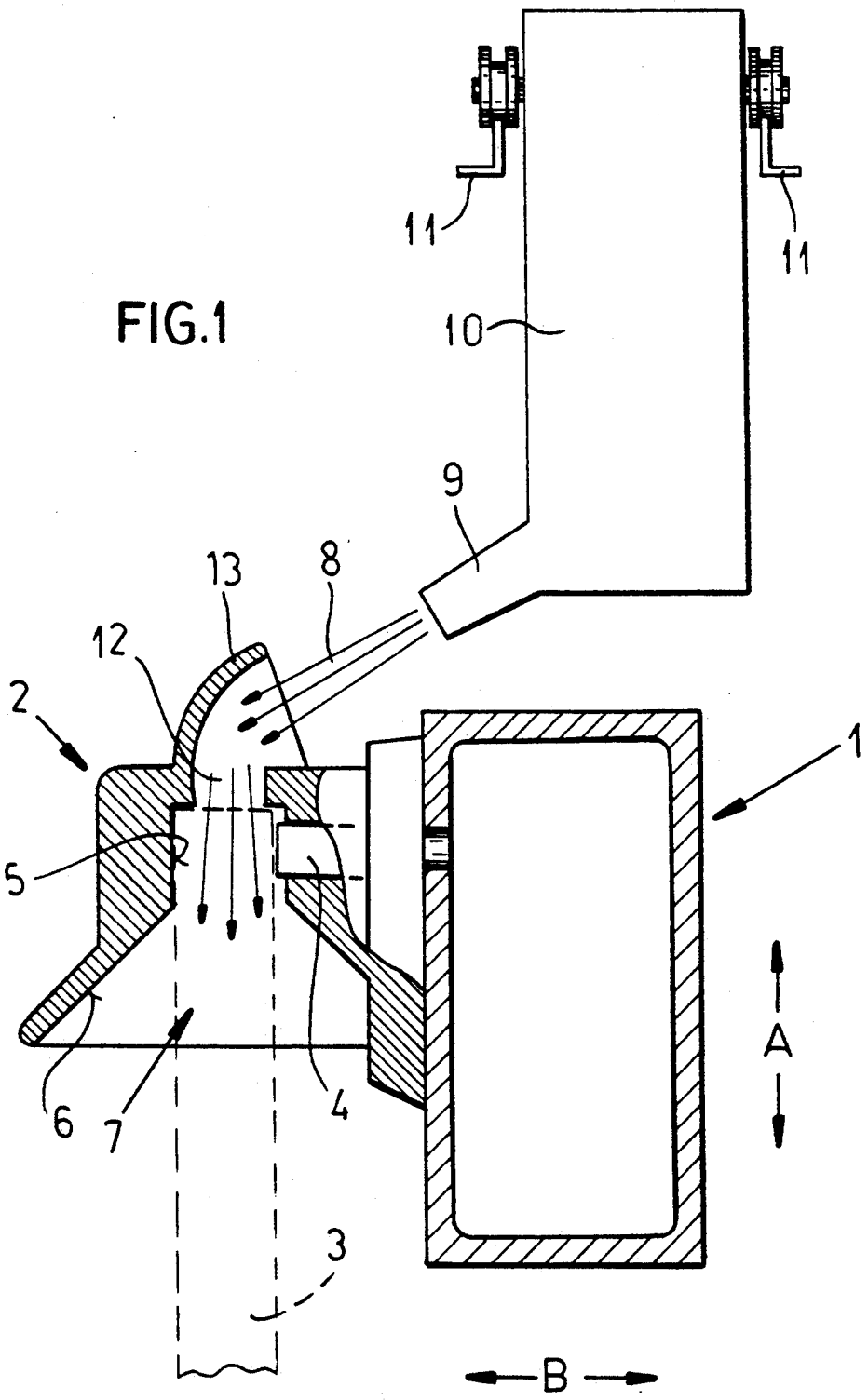
FIG. 1 is a mainly schematic and partly sectional end view of the apparatus of this invention.

As seen in FIG. 1 a horizontal beam 1 of a spinning machine which is movable as is standard vertically in direction A and horizontally in direction B supports a row of identical grabs 2 of which only one is shown. Each grab 2 has a seat 7 formed by a downwardly flaring lower portion 6 and a cylindrical upper portion 5. A bobbin tube 3 can fit into the upper portion 5 to be clamped therein by a clamping element 4, here a horizontally displaceable rod that is movable diametrically of the cylindrical portion 5 and that clamps the upper end of the respective tube 3 against the diametrically opposite wall of the seat portion 5.

Unlike the standard systems where the grab seat 7 is upwardly closed, according to FIG. 1 each grab 2 is formed with a passage 12 that opens downward into the upper end of the respective seat 7 and that is formed at its upper end with an air-trapping hood or cup 13 that opens mainly laterally toward the area directly above the beam 1. A nozzle 9 carried on a blowing apparatus 10 rides on horizontal guide rails 11 parallel to and above the rail 1 such that it can be directed into the air-trapping hood 13. The nozzle 9 emits a jet 8 of compressed air that therefore will be directed downward as indicated by the arrows in the seat 7 to clear any lint from it when the beam 1 has moved the grabs 2 into the appropriate position. The apparatus 10 can travel periodically along the rails 11 to be aimed at each grab 2 when same is empty to periodically clear it, or a machine operator can trigger its operation when any grab is rendered nonoperational from a lint clog.

Figure 2:
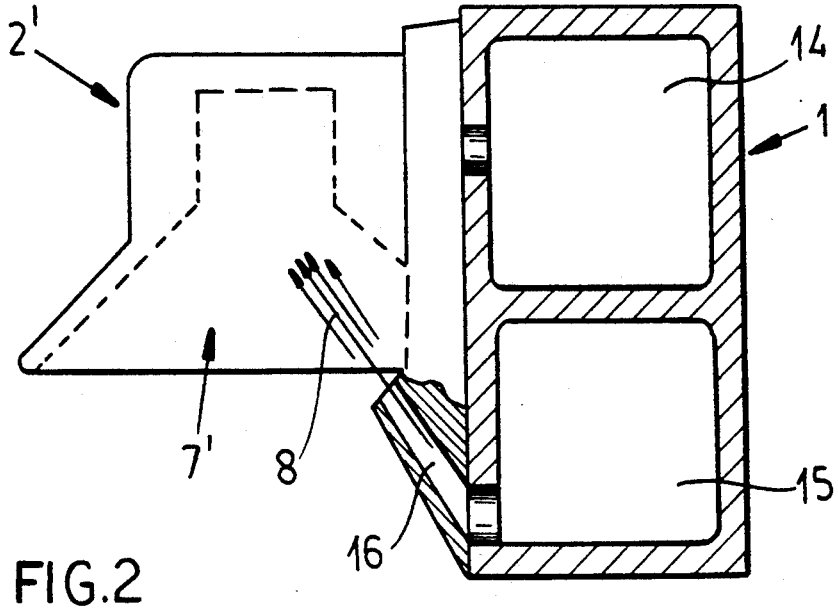
FIG. 2 is a partly sectional end view of another apparatus according to the invention.

In FIG. 2 the arrangement has a grab 2' of conventional upwardly closed shape. Here the beam 1 is formed with an upper compartment 14 that is pressurized to push out the unillustrated clamping element 4 and a lower compartment 15 that opens into a nozzle 16 directed upward into the respective recess 7'. Thus when the chamber 14 is depressurized, which happens when the grabs 2' are empty, the chamber 15 is pressurized to blow lint from the recesses 7'.

Figure 3:
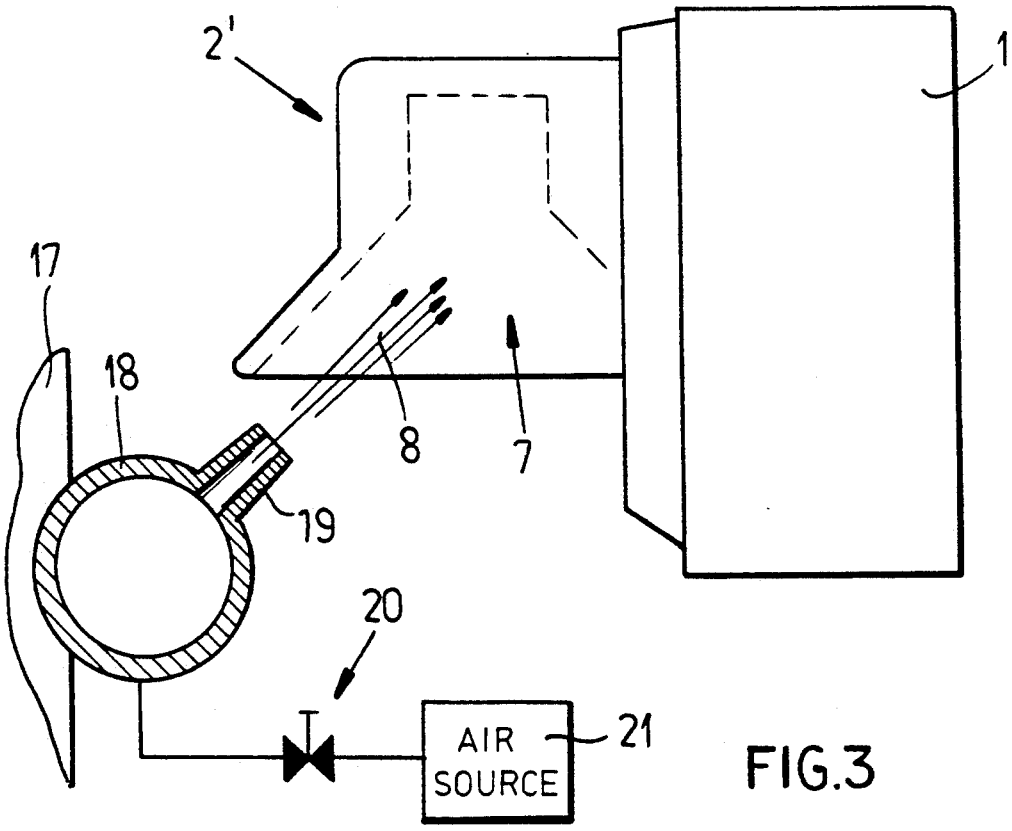
FIG. 3 is a similar view of yet another apparatus in accordance with the invention.

The system of FIG. 3 has an upwardly closed grab 2' like FIG. 2, but here a conduit 18 mounted on a machine frame 17 extends parallel to the beam 1 and is provided at each grab 2' with a respective upwardly directed nozzle 19 that is pointed upward into the recess 7'. The conduit 18 is connected via a valve 20 to a source 21 of compressed air. Opening of the valve 20 causes all of the nozzles 19 on the conduit 18 to blast any lint out of the respective grabs 2'. In this arrangement as in that of FIG. 2 the nozzles 19 could be directed vertically straight up into the grabs 2'.

We claim:

1. In a spinning machine wherein a row of grabs having seat cavities are adapted to engage over tubes in respective spinning stations to remove the tubes from and insert the tubes into the respective stations, a cleaning apparatus comprising:

at least one nozzle directed into the seat cavities of the grabs; and means for supplying air under pressure to the nozzle and thereby forming at the nozzle a jet that is directed into and that blows lint from the seat cavity into which the nozzle is directed.

2. The spinning-machine cleaning apparatus defined in claim 1 wherein each such grab is provided with a respective such nozzle.

3. The spinning-machine cleaning apparatus defined in claim 1, further comprising:

a guide extending along the row of grabs; and means for displacing the nozzle along the guide.

4. The spinning-machine cleaning apparatus defined in claim 1 wherein the grabs are each movable along a predetermined path, the nozzle being disposed along the paths for directing the jet into the grabs as the grabs pass.

5. The spinning-machine cleaning apparatus defined in claim 1 wherein the seat cavities of the grabs are downwardly open cavities, the nozzle being directed upward into the cavity.

6. The spinning-machine cleaning apparatus defined in claim 1 wherein the seat cavities of the grabs are downwardly open cavities and the grabs are formed with respective passages each having a downstream end open downward into the respective cavity and an upstream end, the nozzle being directed into the upstream passage end.

7. The spinning-machine cleaning apparatus defined in claim 1 wherein each grab is provided with an element displaceable across the grab to engage a one of the tubes therein by clamping same.

8. In a spinning machine wherein a row of grabs having seat cavities are adapted to engage over tubes in respective spinning stations to remove the tubes from and insert the tubes into the respective stations, the improvement wherein:

the seat cavities of the grabs are downwardly open and the grabs are formed with respective passages each having a downstream end open downward into the respective cavity and an upstream end;

at least one nozzle is directed into the upstream passage ends; and means is provided for supplying air under pressure to the nozzle and thereby forming at the nozzle a jet that is directed into and that blows lint from the seat cavity into which the nozzle is directed.

9. The spinning-machine cleaning apparatus defined in claim 1 wherein each grab is formed at the upstream end of the respective passage with a laterally open air-catching scoop, the nozzle being directed laterally into the scoop.

* * * * *